US005203812A

United States Patent [19]

Eckold et al.

[11] Patent Number: 5,203,812

[45] Date of Patent: Apr. 20, 1993

[54] METHOD OF CONNECTING TWO COMPONENTS

[76] Inventors: Gerd-Jurgen Eckold, Silbergutte 11, D-3424 St. Andreasberg; Hans Maass, Germelmannstr. 12, D-3422 Bad Lauterberg, both of Fed. Rep. of Germany

[21] Appl. No.: 598,504

[22] Filed: Oct. 16, 1990

[30] Foreign Application Priority Data

Oct. 18, 1989 [DE] Fed. Rep. of Germany ..... 3934743

[51] Int. Cl.[5] ..... B21D 39/00

[52] U.S. Cl. ..... 29/522.1; 29/464; 29/521

[58] Field of Search ..... 29/509, 521, 522.1, 29/432, 432.1, 21.1, 524.1, 464, 467; 403/285

[56] References Cited

U.S. PATENT DOCUMENTS

| | | | |
|---|---|---|---|
| 3,724,063 | 4/1973 | Brown et al. | 29/522.1 X |
| 3,828,517 | 8/1974 | Johnson . | |
| 4,174,559 | 11/1979 | Persik et al. | 29/524.1 X |
| 4,831,711 | 5/1989 | Rapp | 29/521 X |

FOREIGN PATENT DOCUMENTS

| | | | |
|---|---|---|---|
| 0155618 | 3/1985 | European Pat. Off. . | |
| 0155619 | 9/1985 | European Pat. Off. . | |
| 0259925 | 3/1988 | European Pat. Off. . | |
| 918090 | 8/1954 | Fed. Rep. of Germany . | |
| 2371252 | 7/1978 | France | 29/522.1 |
| 0039184 | 10/1978 | Japan | 29/521 |
| 1217614 | 3/1986 | U.S.S.R. | 29/521 |

*Primary Examiner*—Mark Rosenbaum
*Assistant Examiner*—S. Thomas Hughes
*Attorney, Agent, or Firm*—Townsend and Townsend

[57] ABSTRACT

Method of connecting two components by deforming material of one component into a widening hole of the other component and squeezing the pressed-in material outward until the hole is at most filled The connection is effected by a single press stroke.

3 Claims, 1 Drawing Sheet

METHOD OF CONNECTING TWO COMPONENTS

BACKGROUND OF THE INVENTION

1. Field of the Invention

The present invention relates generally to a method of connecting two components and more particularly to a method for connecting components by deforming the material of one component into a hole in the other component.

In the production of numerous objects, of which we shall mention here just household appliances and motor vehicles, two components which bear on one another in a planar manner in the area of the connecting point are to be connected to one another. For example, a clip may be fixed to a motor-vehicle body or a bearing bush to a washing machine wall, or the like. A technique referred to as "projection welding" is most frequently used in such cases, but riveting and screwing ar also commonly employed.

Compared with the other techniques, projection welding has the advantage that the components remain fluid-tight, which is desired or even necessary in many cases. But it has the disadvantage that, in the case of parts coated on the surface, depending on the type of coating, either welding is not possible at all without pretreatment or else, in particular in the case of galvanized steel parts, the zinc coating is damaged in the area of the weld.

2. Description of the Relevant Art

U.S. Pat. No. 3,828,517 discloses a method of connecting a relatively thin first component to a relatively thick second component in which, in first, separate operations, the thin component is perforated and if need be provided with a chamfer, the thick component is subjected to an extrusion operation in such a way that a rivet fitting into the hole is integrally formed and finally, during the actual connecting, the rivet is inserted into the hole and the rivet head is formed on the side of the thin component remote from the thick component. If, during the connection of two components of different thickness, it is desired to provide the recess not in the thick component but in the thin component, for example for aesthetic reasons, this known method cannot be used, since not enough material can be driven through for forming the rivet head.

This also applies to the method in which an apparatus according to EP-A-155,618 is used.

German Patent Specification 918 090 discloses a connecting method of two workpieces wherein exterior positioning means are provided to hold the workpieces, one thereof being plasticly deformed into a tapering hole of the other. The material to be deformed must be transferred from the outer side of the workpiece in direction to the other workpiece with the result that extremely high deformation forces are required.

SUMMARY OF THE INVENTION

It is the object of the present invention to provide a method to connect two workpieces wherein the drawbacks of the prior art as mentioned above are overcome.

Briefly, the method of the invention provides a connection of a first, thicker workpiece and a second, thinner workpiece. The first workpiece has a stepped hole having its smaller section adjacent the second workpiece. A support extends into the hole's larger section but only to a depth that the step remains unimpeded. By means of a punch moved by a single press stroke, material of the second workpiece opposite the hole is pushed deep into the smaller hole section so as to form a cup-shaped protuberance without cuts. The cup bottom, upon further punch displacement, engages the support and is laterally extruded so as to fill in behind the step of the hole. In this way, a secure connection which resists separation is formed.

Further features and advantages of the invention will become apparent from the following detailed description of a preferred embodiment illustrated in the drawing.

BRIEF DESCRIPTION OF THE DRAWINGS

The lefthand side of FIG. 1 illustrates in section with workpieces and deformation means prior to the connecting step while the righthand portion of the drawing shows the parts after the press has reached its stroke end.

DESCRIPTION OF THE SPECIFIC EMBODIMENTS

Figure 1:
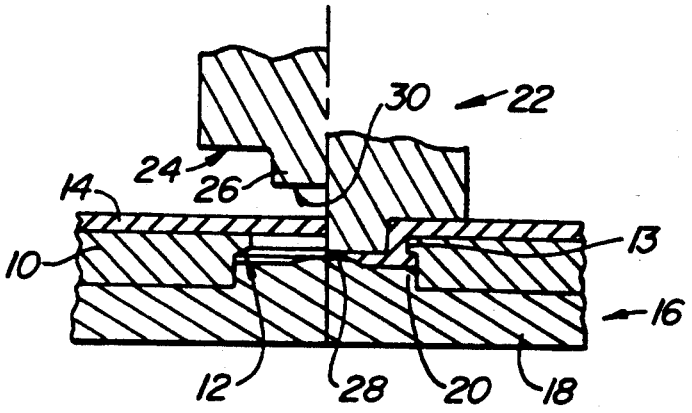

The first workpiece or component 10 is provided with a stepped bore 12 with a smaller orifice 13 facing a second workpiece or component 14. Deformation is effected by means of two press punches 16 and 22. The bottom press punch or support 16 comprises a bearing plate 18 having a projecting centering head 20 whose cross-section is complementary to the larger cross-section of the bore 12 (it should be noted that the term "bore" is to include all conceivable cross-sectional shapes, that is, not only cylindrical drilled holes, but also triangular, hexagonal, square holes, etc. In this way, the first component is positioned relative to the top press tool 22, which includes a punch 26 provided with a collar 24. The collar 24 limits the penetration depth of the punch 26, as can be recognized in the right-hand half of the figure. The cross-section of the punch 26 is dimensioned in such a way that the second component is not cut into but sufficient material is driven through that, when the penetration depth is reached, driven-through material flows laterally behind the bore shoulder and a positive locking connection results. The centering head 20 is dimensioned in the axial direction in such a way that, when the penetration depth of the punch is reached, a minimum distance remains between a crowned projection 28 of the centering head and the end face 30 of the punch, so that the joint location becomes fluid-tight. The finished joint location has on either side a depression of regular shape which can, for example, be filled in and painted over.

It should be noted that a plurality of connections between two components can be produced by the use of multiple tools by means of a single press stroke.

Although the foregoing invention has been described in detail for purposes of clarity of understanding, it will be obvious that certain modifications may be practiced within the scope of the appended claims.

What is claimed is:

1. A method of connecting a first workpiece having a connection area with a first thickness to a second workpiece having a connection area with a second thickness smaller than said first thickness, said first workpiece having a preformed hole therethrough with a first, smaller section adjacent said second workpiece and a second, larger section remote from said second workpiece, said sections being separated by a step, said method comprising pressing a punch against the connection area of said second workpiece causing deformation of material from the second workpiece into said hole with a single press stroke and without cutting through said second workpiece, whereby material of the second workpiece is extruded through the small section and into the large section of said hole, positioning said first workpiece by means of a support member having a section shape complementary to said second hole section and extending into said hole to an extent such that said step is left unimpeded and said deformed material is extruded beyond said step but not beyond the second section of the hole.

2. The method of claim 1, wherein at least one of said workpieces has a surface coating.

3. A method for connecting a first planar workpiece having a preselected thickness to a second planar workpiece having a predetermined thickness less than that of said first workpiece, said method comprising:

forming a stepped hole through said first workpiece, said hole having a smaller section and a larger section;

placing the second workpiece adjacent a surface of the first workpiece having said smaller section after said hole had been formed therethrough; and pressing material of the second workpiece through the smaller section of the stepped hole so that said material will flow laterally into but not beyond the larger section thereby forming a secure joint, wherein said pressing is performed by positioning a bottom press having a projecting centering head within the larger section of the stepped hole and engaging a punch against the second workpiece thereby forcing material through the smaller section of the stepped hole and against the centering head.

* * * * *